US006722548B2

(12) United States Patent
Odoni et al.

(10) Patent No.: US 6,722,548 B2
(45) Date of Patent: Apr. 20, 2004

(54) COMBUSTION-ENGINED SETTING TOOL

(75) Inventors: Walter Odoni, Planken (LI); Ulrich Rosenbaum, Wangs (CH); Hans Gschwend, Buchs (CH); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/435,110

(22) Filed: May 8, 2003

(65) Prior Publication Data

US 2003/0218042 A1 Nov. 27, 2003

(30) Foreign Application Priority Data

May 21, 2002 (DE) ..... 102 22 338

(51) Int. Cl.[7] ..... B25C 1/14
(52) U.S. Cl. ..... 227/8; 227/10; 227/130
(58) Field of Search ..... 227/10, 8, 130, 227/2, 5; 173/2; 123/46 SC

(56) References Cited

U.S. PATENT DOCUMENTS 5,732,870 A * 3/1998 Moorman et al. ..... 227/130
5,873,508 A * 2/1999 MacVicar et al. ..... 227/10
6,102,270 A * 8/2000 Robinson ..... 227/10
6,145,724 A * 11/2000 Shkolnikov et al. ..... 227/8
6,318,615 B1 * 11/2001 Walter ..... 227/10
6,382,492 B1 * 5/2002 Moorman et al. ..... 227/8
6,431,425 B1 * 8/2002 Moorman et al. ..... 227/8
6,604,664 B2 * 8/2003 Robinson ..... 227/8

* cited by examiner

*Primary Examiner*—Scott A. Smith
(74) *Attorney, Agent, or Firm*—Sidley Austin Brown & Wood, LLP

(57) ABSTRACT

A combustion-engined setting tool for driving fastening elements in a constructional components includes at least one mechanically controlled valve (14) arranged in a feeding conduit (12) that connects a reservoir (11) with an oxidation agent or fuel with the tool combustion chamber (13), a switch element (15) for time-delayed opening of the mechanically controlled valve (14) upon being actuated, and at least one normally open, electronically controlled valve (24) likewise arranged in the feeding conduit.

9 Claims, 6 Drawing Sheets

COMBUSTION-ENGINED SETTING TOOL

BACKGROUND OF THE INVENTION

1. Field of the Invention

The invention relates to a combustion-engined setting tool for driving fastening elements in a constructional component and including a reservoir for storing fuel or oxidation agent, a combustion chamber, a feeding conduit connecting the reservoir with the combustion chamber, at least one mechanically controlled valve arranged in the feeding conduit for controlling flow of the fuel or oxidation agent therethrough, and a switch element for time-delayed opening of the mechanically controlled valve in response to actuation of the switch element.

2. Description of the Prior Art

Combustion-engined setting tools of the type described above are well known. Such tools can be operated on both gaseous fuel or liquid fuel that is combusted in the combustion chamber for driving the tool drive piston that drives a fastening element in a constructional component.

In general, a problem with such tools consists in admixing of a properly proportioned amount of air or oxygen, which is used as an oxidation agent, to the fuel for each operational cycle. In particular, the air, which is drawn from the surrounding atmosphere, is subjected to pressure and temperature variations which can unfavorably influence the combustion of the fuel-air mixture when the mixture contains too much or too little fuel.

German Publication DE-42 43 617 A1 discloses a setting tool including a gas inlet valve which opens with mechanical means during an operational cycle to provide for flow of fuel from a fuel source in a storage chambre connected with the surrounding atmosphere. This connection permits to equalize the pressure and, if needed, the temperature in the chamber with those of the surrounding air, so that a properly proportioned fuel-air mixture reaches the combustion chamber. The fuel-air mixture is fed into the combustion chamber at a predetermined time. The drawback of this solution consists in that the connection with the surrounding air leads to some loss of the fuel.

European Patent EP-0 597 241 B1 discloses a combustion-engined setting tool in which the feeding of the fuel from a fuel source into a combustion chamber is controlled by a normally closed solenoid valve. The valve operation is controlled by a switching circuit which in response to actuation of a switch, opens the valve after a predetermined time delay to provide for flow of fluid from the fuel source into the combustion chamber.

The drawback of the setting, tool disclosed in EP-0 597 241 B1 consists in that the tool becomes inoperative when the electronic control falls, e.g., the power source becomes discharged or one of electronic components becomes defective. In case of any failure, the valve remains closed.

Accordingly, an object of the present invention is a setting tool of the type described above in which the drawbacks of the prior aft setting tools are eliminated.

SUMMARY OF THE INVENTION

This and other objects of the present invention, which will become apparent hereinafter, are achieved by providing a combustion-engined setting tool including at least one mechanically controlled valve arranged in the feeding conduit for controlling flow of the fuel or oxidation agent therethrough, a switch element for time-delayed opening of the mechanically controlled valve in response to actuation of the switch element, and at least one normally open electronically controlled valve likewise arranged in the feeding conduit for controlling the flow of the oxidation agent or fuel from the reservoir into the combustion chamber.

The normally open, electronically controlled valve is preferably arranged, in the flow direction of the fuel or the oxidation agent, downstream of the mechanically controlled valve. The electronically controlled valve remains open, in particular, when the electronic control circuit for controlling the electronically controlled valve falls, e.g., due to an interruption of voltage supply. The mechanically controlled valve can be open in response to action of mechanical controlling means, e.g., trigger, nose button switch, magazine switch, and so forth, alone or in combination. The predetermined opening time period of the mechanically controlled switch can be so selected that the fuel-air mixture would contain an excess of fuel so that an optimal combustion could not be achieved. However, the mixture can still be ignited, so that in case of failure of the electronics, the setting tool is still operative.

Advantageously, the predetermined opening time period of the mechanically controlled valve is so selected that during an operational cycle, that time period exceeds the maximal flow-through time period of the fuel through the electronically controlled valve which flow-through time is determined by an electronic control circuit for each operational cycle a new dependent on predetermined parameters.

Advantageously, there is provided a flow meter for measuring an amount of fuel flowing into the combustion chamber. The flow meter communicates with the control circuit. The control circuit processes the information supplied by the flow meter and closes the electronically controlled valve when the amount of fuel measured by the flow meter reaches, during the operational cycle, an optimal value.

In order to adapt the amount of fuel to the surrounding environmental conditions, e.g., to the temperature, air pressure, and air humidity, there is provided sensor means for determining the environmental condition parameters.

The sensor means generates corresponding signals and communicate them to the control circuit. The control circuit determines, for each operational cycle, a set amount of fuel to be fed into the combustion chamber in accordance with the determined parameters of the environmental conditions. The sensor means can include sensors for determining air pressure, temperature, and humidity of surrounding air.

With the electronically controlled valve being formed as a piezo valve, a more rapid reaction time in response to the control signal is achieved, providing for a correct and error-free closing and opening of the valve.

Advantageously, the control circuit includes a parameter processing unit which is formed as or includes a microprocessor.

Proper proportioning of the fuel-air mixture can be obtained, in case the reservoir contains an oxidation agent, by controlling the flow of the oxidation agent into the combustion chamber in a manner described above with reference to controlling the flow of the fuel. Moreover, the proportioning of the fuel-air mixture can be effected by both controlling the flow of fuel and controlling the flow of the oxidation agent.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
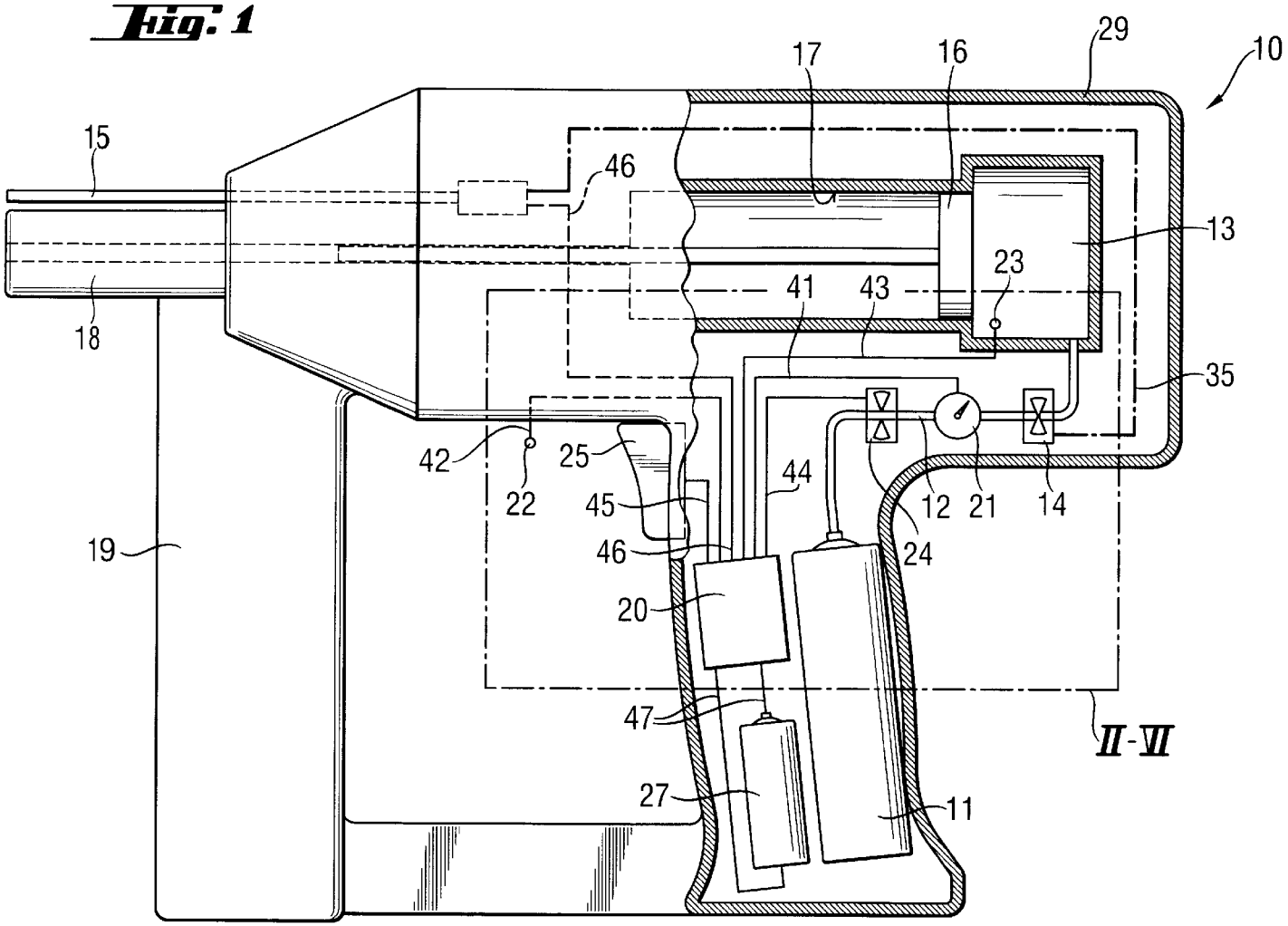
FIG. 1 a side, partially cross-sectional view of a setting tool according to the present invention.
Figure 2:
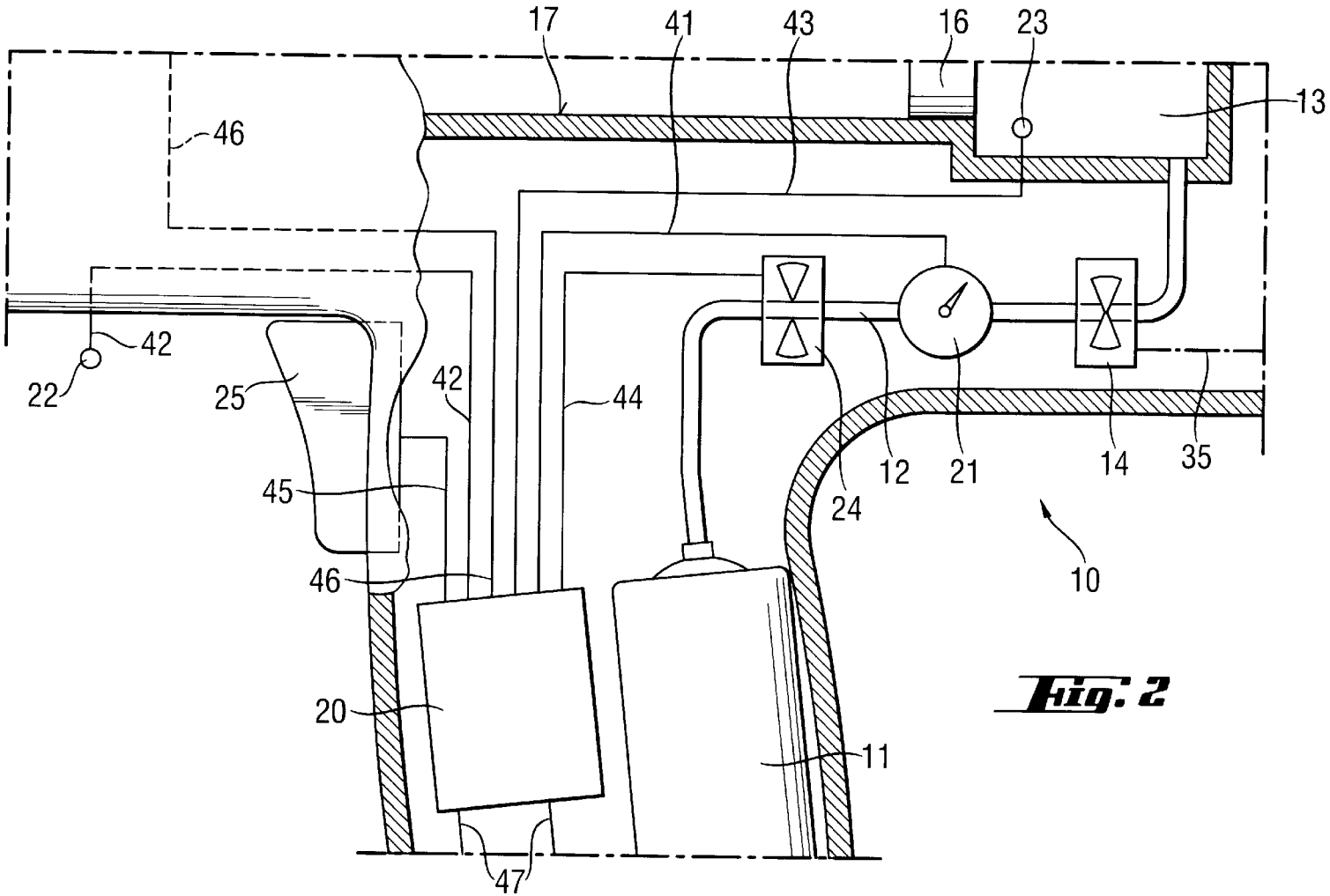
FIG. 2 a partially cross-sectional view of the section II-IV of the setting tool shown in FIG. 1 in an off-position of the setting-tool.

A combustion-engined setting tool 10 according to the present invention is shown in FIGS. 1–2 in its off or initial position. The inventive setting tool 10 is powered with a fuel gas. The setting tool 10 has a housing 29 in which a setting mechanism is arranged and with which a fastening element can be driven in a constructional component when the setting tool is pressed against a constructional component and is actuated.

The setting mechanism includes, among others, a combustion chamber 13, a piston guide 17, a drive piston 16 arranged in the piston guide 17, and a bolt guide 18 in which a fastening element can be advanced by a forwardly moving, facing in a setting direction, end of the drive piston 16 and thereby driven into a constructional component. The fastening elements can be, e.g., stored in a magazine 19 attached to the setting tool 10.

In the embodiment shown in the drawings, an ignition element, e.g., a spark plug 23 is arranged in a combustion chamber 13 for igniting a fuel gas-air mixture introduced or formed in the combustion chamber 13 for effecting a setting process. Feeding of the fuel gas into the combustion chamber is effected through a feeding conduit 12 from a fuel reservoir 11. In the feeding conduit 12, there are provided a first electronically controlled valve 24, e.g., a priezo valve, a flow meter 21 arranged downstream of the valve 24 in the flow direction of the fuel, and a mechanically controlled valve 14 arranged downstream of the flow meter 21.

The mechanically controlled valve 14 is connected with a switch 15, e.g., a nose button switch, which is arranged in the region of the bolt guide 18 of the setting tool 10 by a mechanical switch path 35, e.g., by a switch rod.

The setting tool 10 according to the present invention further includes an electronic control circuit 20 that is connected with a power source 27, e.g., a battery or an accumulator, by electrical conductors 47.

The control circuit 20 can include, e.g., a microprocessor in which a control program for one or more tool functions can be executed. The control circuit 20 can control metering of the fuel by controlling the operation of the electronically controlled valve 24.

The control circuit 20 is connected with the valve 24 by an electrical conductor 44 and is connected with the flow meter 21 by an electrical conductor 41. The control circuit 20 is also connected by an electrical conductor 43 with the spark plug 23. The switch 15 has an electronic output connected with the control circuit 20 by an electrical conductor 46. The trigger switch 25, which is provided on the tool handle, is also electronically connected, in the embodiment shown in the drawings, with the control circuit 20 by an electrical conductor 25. In the control circuit 20, measurement data and parameters, which are communicated from different sensors, e.g., a sensor 22 for sensing the air pressure and the air humidity, can be processed. The sensor 22 is connected with the control circuit 20 by an electrical conductor 42. The electrical conductors 41, 42, 43, 44, 45, 46, and 47 can be used for feeding electrical energy and for the electronic data transmission.

In the off-position of the setting tool shown in FIGS. 1–2, the electronically controlled valve 24 is open, and the mechanically controlled valve 14 is closed.

Figure 3:
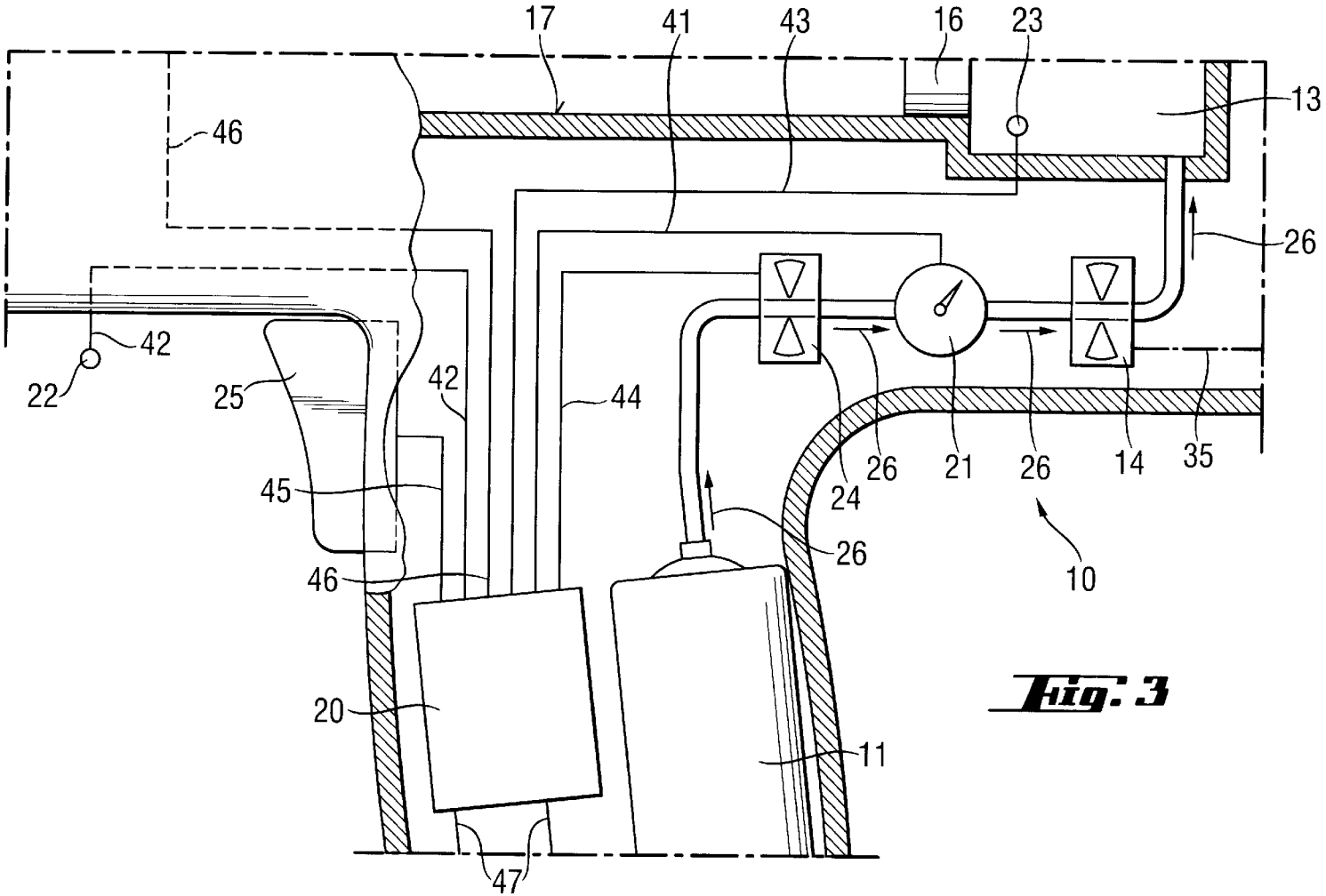
FIG. 3 a partially cross-sectional view of the section II-IV of the setting tool shown in FIG. 2 in a press-on position of the setting tool.

FIG. 3 shows a position of the setting tool 10 in which the tool is pressed against a constructional component, whereby the switch 15 (not shown in FIG. 3) is actuated. The mechanical switch rod 35 transmits the actuated state of the switch 15 to the mechanically controlled valve 14 which opens in response to the actuated state of the switch 15. With both valves 14, 24 being open, the fuel can flow into the combustion chamber 13 of the tool 10 in the flow direction 26 in the conduit 12 through the valve 14, the flow meter 21, and the valve 24.

Figure 4:
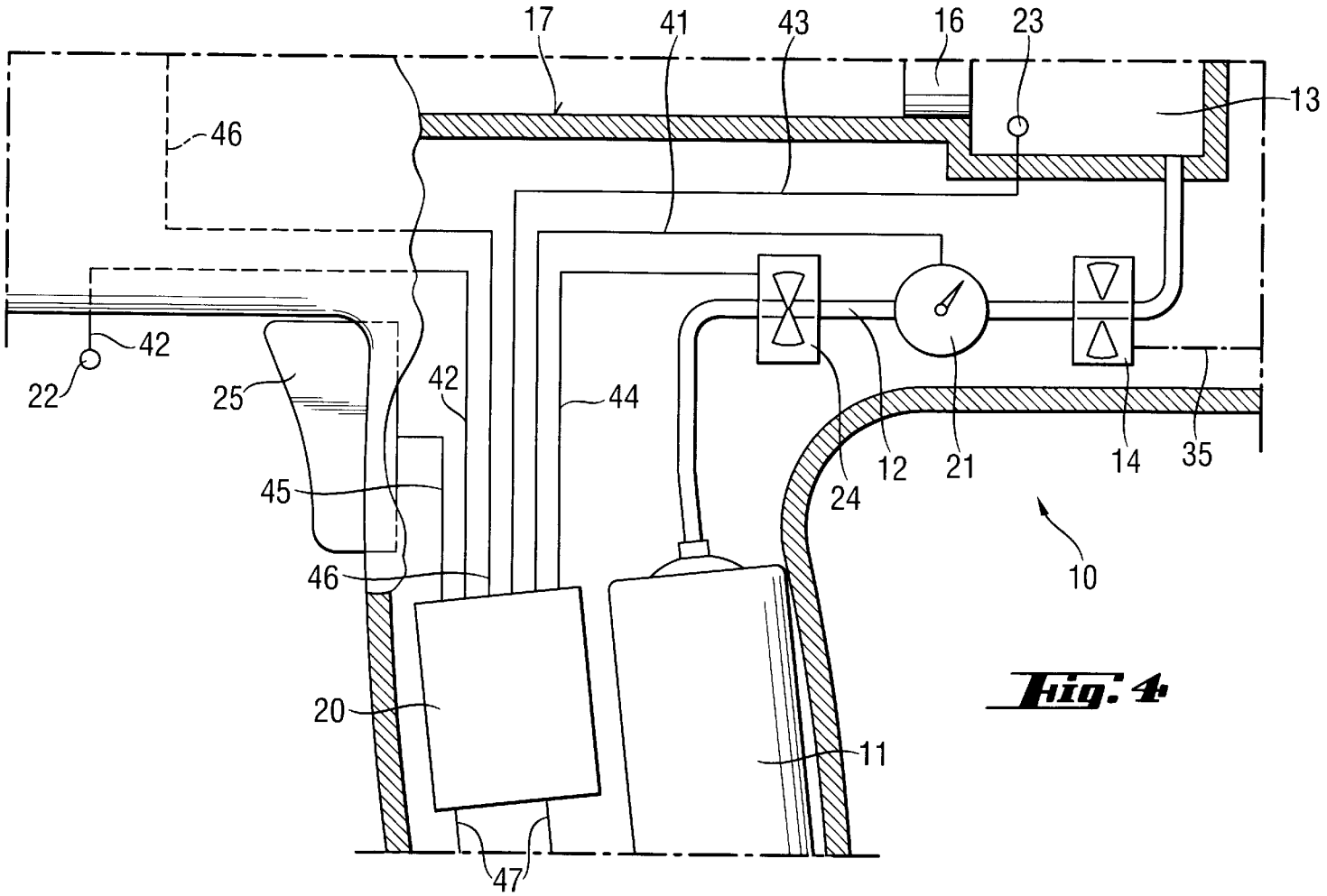
FIG. 4 a partially cross-sectional view of the section II-IV of the setting tool shown in FIG. 2 in a press-on position at a point in time later than in FIG. 3.

In the position shown in FIG. 4, the setting tool 10 is still pressed against the constructional component. In this position, the control circuit 20 transmits, through the electrical conductor 44, a closing state signal to the electronically controlled valve 24 as the measurement of the flow meter 21 shows that an optimal amount of fuel has been fed into the combustion chamber 13, with the optimal amount being determined, by the control circuit 20, based on environmental data transmitted by the sensor 22. Before that, the start point for measuring the fuel flow by the flow meter 21 was set by the control circuit 20 in response to actuation of the switch 15. The actuation state of the switch 15 was communicated to the control circuit 20 via the control conductor 46.

Figure 5:
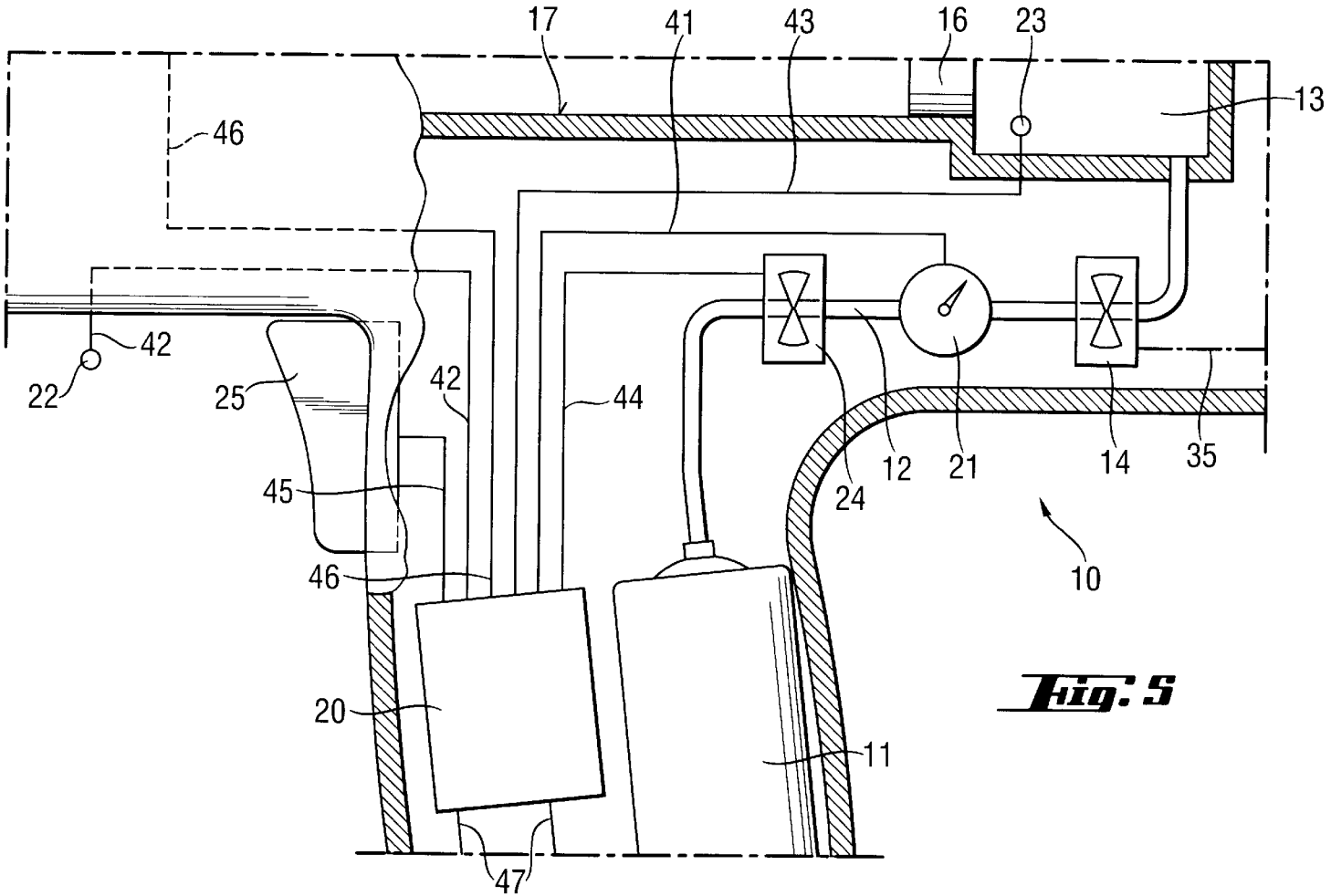
FIG. 5 a partially cross-sectional view of the section II-IV of the setting tool shown in FIG. 2 in a press-on position at a point in time later than in FIG. 4.

In the position shown in FIG. 5, the setting tool 10 is still pressed against the constructional component. However, the mechanically controlled valve 14 is closed. The closing of the valve 14 is effected automatically upon expiration of a predetermined time period that determines the time the valve 14 remains open after it has been open in response to the actuation of the switch 15. The time the valve 14 remains open can, e.g., be so selected that it closes only after the electronically controlled valve 24 becomes closed. This measure insures that the setting tool 10 remains operational even after the failure of the electronically controlled valve 24 and at any environmental conditions, and in case the power is reduced.

Figure 6:
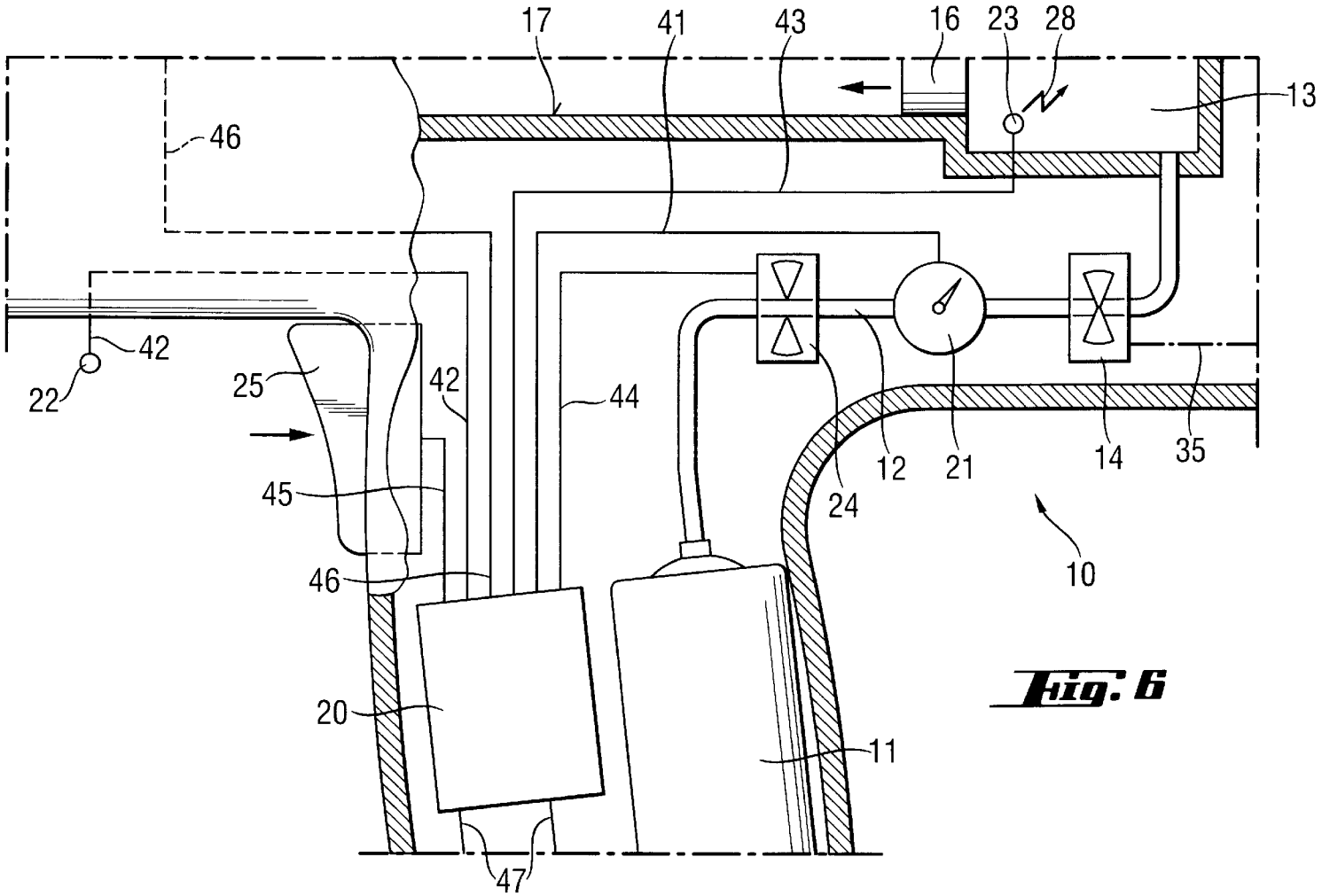
FIG. 6 a partially cross-sectional view of the section II-IV of the setting tool shown in FIG. 2 in a press-on position with actuated trigger switch.

In the position shown in FIG. 6, the setting tool 10 continues to be pressed against the constructional component. In this position, the tool user actuates the trigger switch 25. The actuation of the trigger switch 25 is transmitted to the control circuit 20 by the control conductor 45. The control circuit 20 processes the trigger switch actuation signal and immediately generates an ignition signal. In response to the ignition signal, ignition current flows through the electrical conduit 43 to the spark plug 23 that generates a spark 28 for igniting the fuel-air mixture in the combustion chamber 23. Simultaneously, an opening signal is transmitted by the conductor 44 to the electronically controlled valve 24 for opening the same. After the setting process, which was initiated by the spark 28, has been completed, the setting tool 10 returns to its initial off-position shown in FIGS. 1–2 after the setting tool 10 was lifted off the constructional component.

The opening of the electronically controlled valve 24 can also be time-controlled. Alternatively, the opening of the valve 24 can be connected with the closing of the mechanically controlled valve 14. In this case, a device for transmitting the closing of the mechanically controlled valve 14 to the control circuit 20 is required.

The present invention was described for the case where the reservoir contains fuel (fuel gas). However, instead of the fuel, the reservoir can contain an oxidation agent. Nevertheless, the structure and function of all of the discussed elements of the setting tool will remain the same.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A combustion-engined setting tool for driving fastening elements in a constructional component, comprising a reservoir (11) for storing one of fuel and oxidation agent; a combustion chamber (13); a feeding conduit connecting the reservoir (11) with the combustion chamber (13); at least one mechanically controlled valve (14) arranged in the feeding conduit (12) for controlling flow of the one of fuel and oxidation agent therethrough; switch means (15) for time-delayed opening of the mechanically controlled valve (14) in response to actuation of the switch means (15); and at least one normally open, electronically controlled valve (24) likewise arranged in the feeding conduct (12) for controlling the flow of the one of oxidation agent and fuel.

2. A setting tool according to claim 1, further comprising an electronic control circuit (20) that insures closing of the electronically controlled valve (24) during an operational cycle before the mechanically controlled valve (14) closes.

3. A setting tool according to claim 2, where the reservoir (11) stores fuel, and wherein the setting tool comprises a flow meter (21) for measuring an amount of fuel flowing into the combustion chamber (13) and communicating with the control circuit (20), and wherein the control circuit (20) closes the electronically controlled valve (24) when the amount of fuel measured by the flow meter (21) reaches, during the operational cycle, a set value.

4. A setting tool according to claim 3, further comprising sensor means (22) for determining operational status parameters of the setting tool (10) and environmental condition parameters and communicating with the control circuit (20), the control circuit (20) predetermining, for each operational cycle, a set amount of fuel to be fed into the combustion chamber (13) in accordance with the determined parameters of operational status of the setting tool (10) and of an environmental condition.

5. A setting tool according to claim 4, where in the sensor means (22) comprises sensors for determining air pressure, temperature, and humidity of surrounding air.

6. A setting tool according to claim 1, wherein the electronically controlled valve (24) is actuated by a priezo element.

7. A setting tool according to claim 4, wherein the control circuit (20) comprises a parameter processing unit.

8. A setting tool according to claim 7, wherein the processing unit comprises a microprocessor.

9. A setting tool according to claim 1, wherein the at least one electronically controlled valve (24) is arranged, in a flow direction (26) of the one of oxidation agent and fuel, downstream of the at least one mechanically controlled valve (14).

* * * * *